US007710043B2

(12) United States Patent
Usui

(10) Patent No.: US 7,710,043 B2
(45) Date of Patent: May 4, 2010

(54) DISCHARGE-LAMP LIGHTING APPARATUS

(75) Inventor: Hiroshi Usui, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 233 days.

(21) Appl. No.: 11/748,888

(22) Filed: May 15, 2007

(65) Prior Publication Data

US 2007/0273301 A1 Nov. 29, 2007

(30) Foreign Application Priority Data

May 25, 2006 (JP) ..... 2006-145730

(51) Int. Cl.
*H05B 37/00* (2006.01)

(52) U.S. Cl. ..... 315/219; 315/224; 315/276; 315/277

(58) Field of Classification Search ..... 315/224, 315/219, 274, 275, 276, 277, 279
See application file for complete search history.

(56) References Cited

U.S. PATENT DOCUMENTS 6,784,627 B2 * 8/2004 Suzuki et al. ..... 315/291
7,023,145 B2 * 4/2006 Hwang et al. ..... 315/276

FOREIGN PATENT DOCUMENTS

JP 2003-31383 1/2003

OTHER PUBLICATIONS

U.S. Appl. No. 11/748,821, filed May 15, 2007, Usui.

* cited by examiner

*Primary Examiner*—David Hung Vu
(74) *Attorney, Agent, or Firm*—Oblon, Spivak, McClelland, Maier & Neustadt, L.L.P.

(57) ABSTRACT

A discharge-lamp lighting apparatus includes first and second cold cathode fluorescent lamps (CCFLs) and first and second transformers. The second transformer has a primary winding connected in parallel to one of primary and secondary windings of the first transformer, a first secondary winding, and a second secondary winding. Each of the first and second secondary windings of the second transformer is connected to the secondary winding of the first transformer with polarities being set so that a voltage of each secondary winding of the second transformer becomes additive to a voltage of the secondary winding of the first transformer. The first CCFL is connected in parallel to a series circuit that includes the secondary winding of the first transformer and the first secondary winding of the second transformer.

5 Claims, 10 Drawing Sheets

DISCHARGE-LAMP LIGHTING APPARATUS

BACKGROUND OF THE INVENTION

1. Field of the Invention

The present invention relates generally to a discharge-lamp lighting apparatus for lighting discharge lamps such as cold cathode fluorescent lamps (CCFLs), and particularly, to a technique of simultaneously driving a plurality of CCFLs.

2. Description of the Related Art

FIG. 1 is a view showing a configuration of a discharge-lamp lighting apparatus according to a related art. This apparatus includes a DC power source E connected in series with a first switching element Q1 and a second switching element Q2. The first and second switching elements Q1 and Q2 are turned on and off in response to control signals from a control circuit 10. The control circuit 10 conducts PWM control, phase control, frequency control, or the like to control the on/off operation of the first and second switching elements Q1 and Q2.

The second switching element Q2 is connected in parallel to a quasi-voltage-resonance capacitor C6. The element Q2 is also connected in parallel to a series circuit that includes a primary winding P1 of a first transformer T1 and a current resonance capacitor C4. The first transformer T1 has a leakage inductance Lr for managing resonance operation.

A secondary winding S1 of the first transformer T1 is connected, through a resistor RS, in parallel to a series circuit that includes a cold cathode fluorescent lamp (hereinafter referred to as CCFL) 11*a* and a ballast capacitor C11 and a series circuit that includes a CCFL 11*b* and a ballast capacitor C12. The resistor RS is a current detection resistor to detect a current. A signal representative of the current detected by the resistor RS is fed back to the control circuit 10 on the primary side. According to the signal fed back from the resistor RS, the control circuit 10 controls on/off operation of the first and second switching elements Q1 and Q2, thereby controlling an AC voltage applied to the primary winding P1 of the first transformer T1.

FIG. 2 shows a voltage-current characteristic of a typical CCFL. The CCFL has a negative resistance characteristic that a current (lamp current) increases as an applied voltage (lamp voltage) decreases. To relieve the negative resistance characteristic, an impedance element is inserted in series with a CCFL in the discharge-lamp lighting apparatus. The impedance element must have a sufficient value to absorb the negative resistance characteristic of the CCFL. When driving a single CCFL, the discharge-lamp lighting apparatus uses the leakage inductance Lr of the first transformer T1 as the impedance element.

When simultaneously driving a plurality of CCFLs, simply connecting the CCFLs in parallel with one another causes a problem that a CCFL that is first turned on triggers a voltage drop due to impedance to prevent the other CCFLs from being turned on. To avoid this problem, an impedance element is inserted in series with each CCFL. In the example shown in FIG. 1, the impedance elements are the ballast capacitors C11 and C12. With the ballast capacitors C11 and C12, a voltage applied to the secondary winding S1 of the first transformer T1 becomes free from the ON or OFF state of any CCFL, and therefore, all CCFLs are surely turned on.

Another example of the discharge-lamp lighting apparatus is a multi-lamp drive system disclosed in Japanese Unexamined Patent Application Publication No. 2003-31383. This multi-lamp drive system drives a lamp set consisting of first and second lamps. The system includes a drive circuit for converting a DC signal into an AC signal, a transformer whose primary side is electrically connected to the driver circuit and whose secondary side provides an AC power source, and a current balance circuit electrically connected to the lamp set to balance currents passed to the first and second lamps. The current balance circuit has a core, a first winding electrically connected to the first lamp, and a second winding electrically connected to the second lamp. The first and second windings are wound around the same core and have the same number of turns.

SUMMARY OF THE INVENTION

The discharge-lamp lighting apparatuses mentioned above have problems. In FIG. 1, the first transformer T1 must generate on its secondary winding S1 a high voltage that is the sum of voltages applied to the ballast capacitors C11 and C12 and voltages applied to the CCFLs 11*a* and 11*b*. Due to this, the apparatus must take large-scale safety measures to secure reliability, prevent leakage, and ensure creepage distances and spatial distances. These measures increase the cost of the apparatus.

A discharge-lamp lighting apparatus of the present invention needs no large-scale safety measures, greatly reduces the cost, realizes high reliability, and accurately stabilizes and balances currents passed to CCFLs that are simultaneously driven.

According to a first aspect of the present invention, provided is a discharge-lamp lighting apparatus having a first discharge lamp and a second discharge lamp. The apparatus includes a first transformer having a primary winding and a secondary winding, the primary winding receiving an AC voltage generated by turning on/off switching elements connected to a DC power source, the secondary winding transforming the AC voltage received by the primary winding into an output voltage; a second transformer having a primary winding, a first secondary winding, and a second secondary winding, the primary winding of the second transformer being connected in parallel to one of the primary and secondary windings of the first transformer, each of the first and second secondary windings of the second transformer being connected to the secondary winding of the first transformer with polarities being set so that a voltage of each secondary winding of the second transformer becomes additive to a voltage of the secondary winding of the first transformer. The first discharge lamp is connected in parallel to a series circuit that includes the secondary winding of the first transformer and the first secondary winding of the second transformer. The second discharge lamp is connected in parallel to a series circuit that includes the secondary winding of the first transformer and the second secondary winding of the second transformer.

According to a second aspect of the present invention, provided is a discharge-lamp lighting apparatus having a first discharge lamp and a second discharge lamp. The apparatus includes a first transformer having a primary winding and a secondary winding, the primary winding receiving an AC voltage generated by turning on/off switching elements connected to a DC power source, the secondary winding transforming the AC voltage received by the primary winding into an output voltage; a second transformer having a primary winding and a secondary winding, the primary winding of the second transformer being connected in parallel to one of the primary and secondary windings of the first transformer, the secondary winding of the second transformer being connected to the secondary winding of the first transformer with polarities being set so that a voltage of the secondary winding of the second transformer becomes additive to a voltage of the secondary winding of the first transformer; and a third transformer having a primary winding and a secondary winding, the primary winding of the third transformer being connected in parallel to one of the primary and secondary windings of the first transformer, the secondary winding of the third transformer being connected to the secondary winding of the first transformer with polarities being set so that a voltage of the secondary winding of the third transformer becomes additive to a voltage of the secondary winding of the first transformer. The first discharge lamp is connected in parallel to a series circuit that includes the secondary winding of the first transformer and the secondary winding of the second transformer. The second discharge lamp is connected in parallel to a series circuit that includes the secondary winding of the first transformer and the secondary winding of the third transformer.

According to a third aspect of the present invention, provided is a discharge-lamp lighting apparatus having a first discharge lamp and a second discharge lamp. The apparatus includes a first transformer having a primary winding and a secondary winding, the primary winding receiving an AC voltage generated by turning on/off switching elements connected to a DC power source, the secondary winding transforming the AC voltage received by the primary winding into an output voltage; a second transformer having a primary winding and a secondary winding, the primary winding of the second transformer being connected in parallel to one of the primary and secondary windings of the first transformer, the secondary winding of the second transformer being connected to the secondary winding of the first transformer with polarities being set so that a voltage of the secondary winding of the second transformer becomes additive to a voltage of the secondary winding of the first transformer; and a third transformer having a primary winding and a secondary winding, the primary winding of the third transformer being connected in series with the primary winding of the second transformer, the secondary winding of the third transformer being connected to the secondary winding of the first transformer with polarities being set so that a voltage of the secondary winding of the third transformer becomes additive to a voltage of the secondary winding of the first transformer. The first discharge lamp is connected in parallel to a series circuit that includes the secondary winding of the first transformer and the secondary winding of the second transformer. The second discharge lamp is connected in parallel to a series circuit that includes the secondary winding of the first transformer and the secondary winding of the third transformer.

According to a first aspect of the present invention, provided is a discharge-lamp lighting apparatus having a first discharge lamp and a second discharge lamp. The apparatus includes a first transformer having a primary winding and a secondary winding, the primary winding receiving an AC voltage generated by turning on/off switching elements connected to a DC power source, the secondary winding transforming the AC voltage received by the primary winding into an output voltage; and a second transformer having a primary winding, a first secondary winding, and a second secondary winding, the primary winding of the second transformer being connected in series with one of the primary and secondary windings of the first transformer, each of the first and second secondary windings of the second transformer being connected to the secondary winding of the first transformer with polarities being set so that a voltage of each secondary winding of the second transformer becomes additive to a voltage of the secondary winding of the first transformer. The first discharge lamp is connected in parallel to a series circuit that includes the secondary winding of the first transformer and the first secondary winding of the second transformer. The second discharge lamp is connected in parallel to a series circuit that includes the secondary winding of the first transformer and the second secondary winding of the second transformer.

According to a fifth aspect of the present invention, provided is a discharge-lamp lighting apparatus having a first discharge lamp and a second discharge lamp. The apparatus includes a first transformer having a primary winding and a secondary winding, the primary winding receiving an AC voltage generated by turning on/off switching elements connected to a DC power source, the secondary winding transforming the AC voltage received by the primary winding into an output voltage; a second transformer having a primary winding and a secondary winding, the primary winding of the second transformer being connected in series with one of the primary and secondary windings of the first transformer, the secondary winding of the second transformer being connected to the secondary winding of the first transformer with polarities being set so that a voltage of the secondary winding of the second transformer becomes additive to a voltage of the secondary winding of the first transformer; and a third transformer having a primary winding and a secondary winding, the primary winding of the third transformer being connected in series with one of the primary and secondary windings of the first transformer, the secondary winding of the third transformer being connected to the secondary winding of the first transformer with polarities being set so that a voltage of the secondary winding of the third transformer becomes additive to a voltage of the secondary winding of the first transformer. The first discharge lamp is connected in parallel to a series circuit that includes the secondary winding of the first transformer and the secondary winding of the second transformer. The second discharge lamp is connected in parallel to a series circuit that includes the secondary winding of the first transformer and the secondary winding of the third transformer.

According to a sixth aspect of the present invention, provided is a discharge-lamp lighting apparatus having a first discharge lamp and a second discharge lamp. The apparatus includes a first transformer having a primary winding and a secondary winding, the primary winding receiving an AC voltage generated by turning on/off switching elements connected to a DC power source, the secondary winding transforming the AC voltage received by the primary winding into an output voltage; a second transformer having a primary winding and a secondary winding, the primary winding of the second transformer being connected in series with one of the primary and secondary windings of the first transformer, the secondary winding of the second transformer being connected to the secondary winding of the first transformer with polarities being set so that a voltage of the secondary winding of the second transformer becomes additive to a voltage of the secondary winding of the first transformer; and a third transformer having a primary winding and a secondary winding, the primary winding of the third transformer being connected in series with the primary winding of the second transformer, the secondary winding of the third transformer being connected to the secondary winding of the first transformer with polarities being set so that a voltage of the secondary winding of the third transformer becomes additive to a voltage of the secondary winding of the first transformer. The first discharge lamp is connected in parallel to a series circuit that includes the secondary winding of the first transformer and the secondary winding of the second transformer. The second discharge lamp is connected in parallel to a series circuit that includes the secondary winding of the first transformer and the secondary winding of the third transformer.

DESCRIPTION OF PREFERRED EMBODIMENTS

Discharge-lamp lighting apparatuses according to embodiments of the present invention will be explained in detail with reference to the accompanying drawings.

First Embodiment

Figure 1:
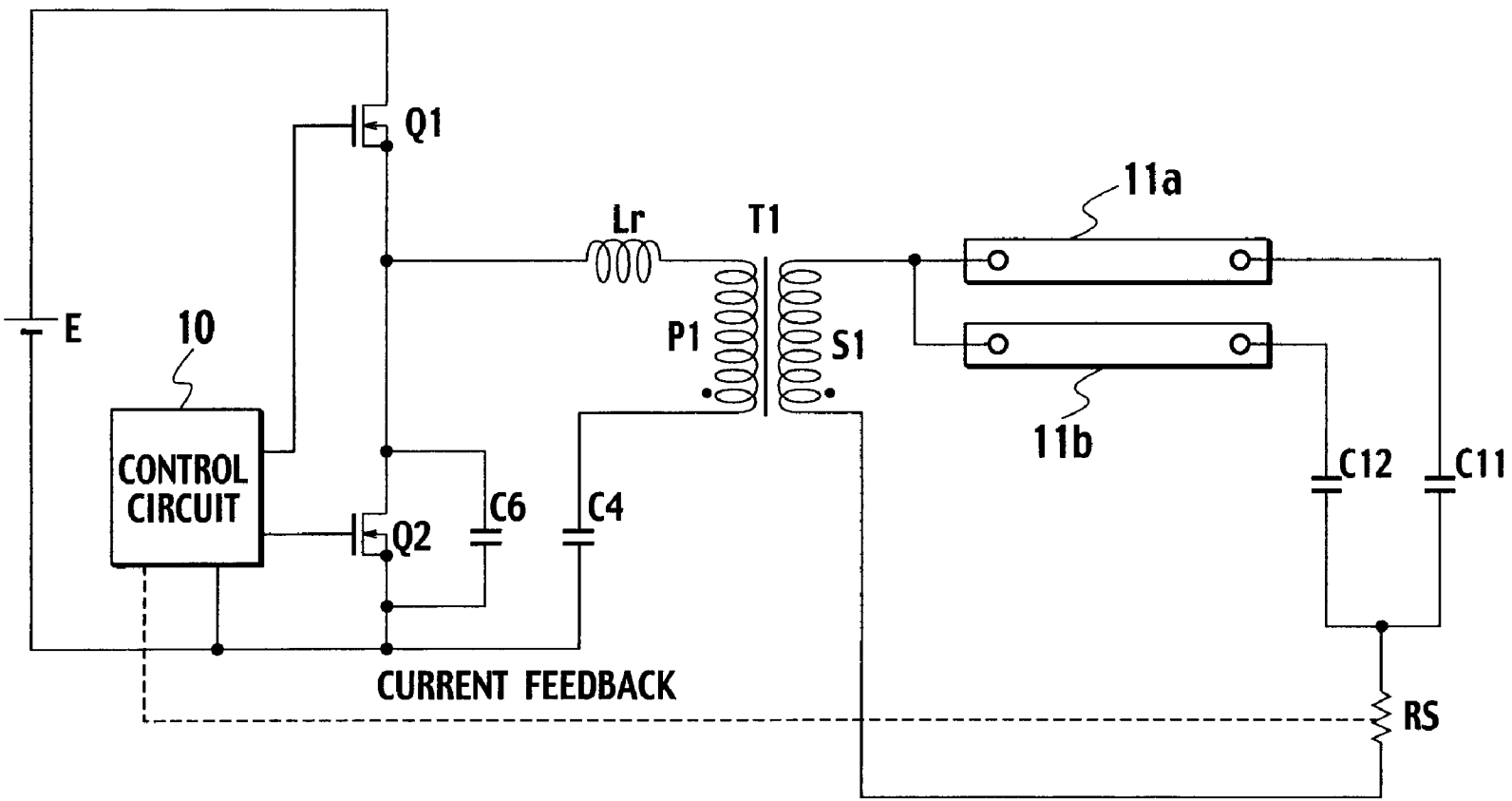
FIG. 1 is a view showing a configuration of a discharge-lamp lighting apparatus according to a related art.
Figure 2:
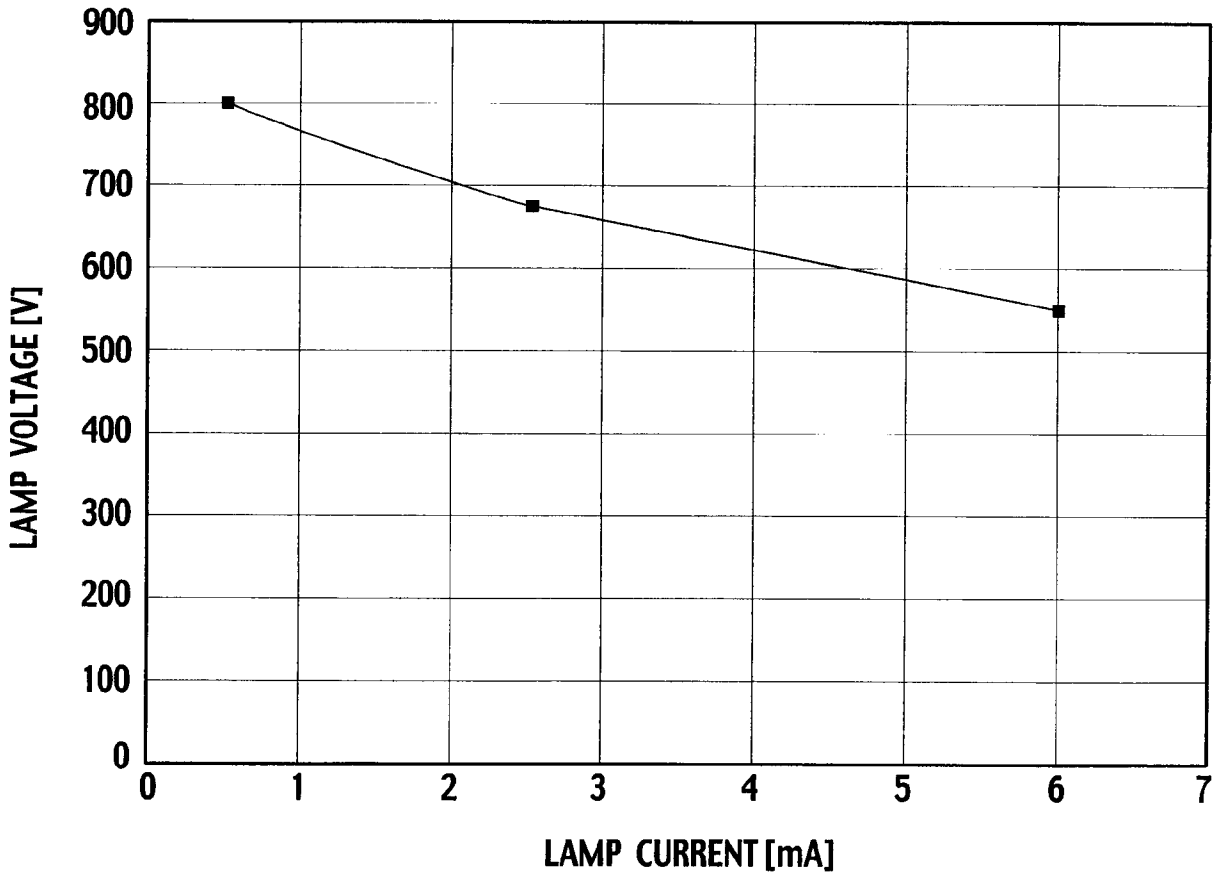
FIG. 2 is a view showing a voltage-current characteristic of a typical CCFL.
Figure 3:
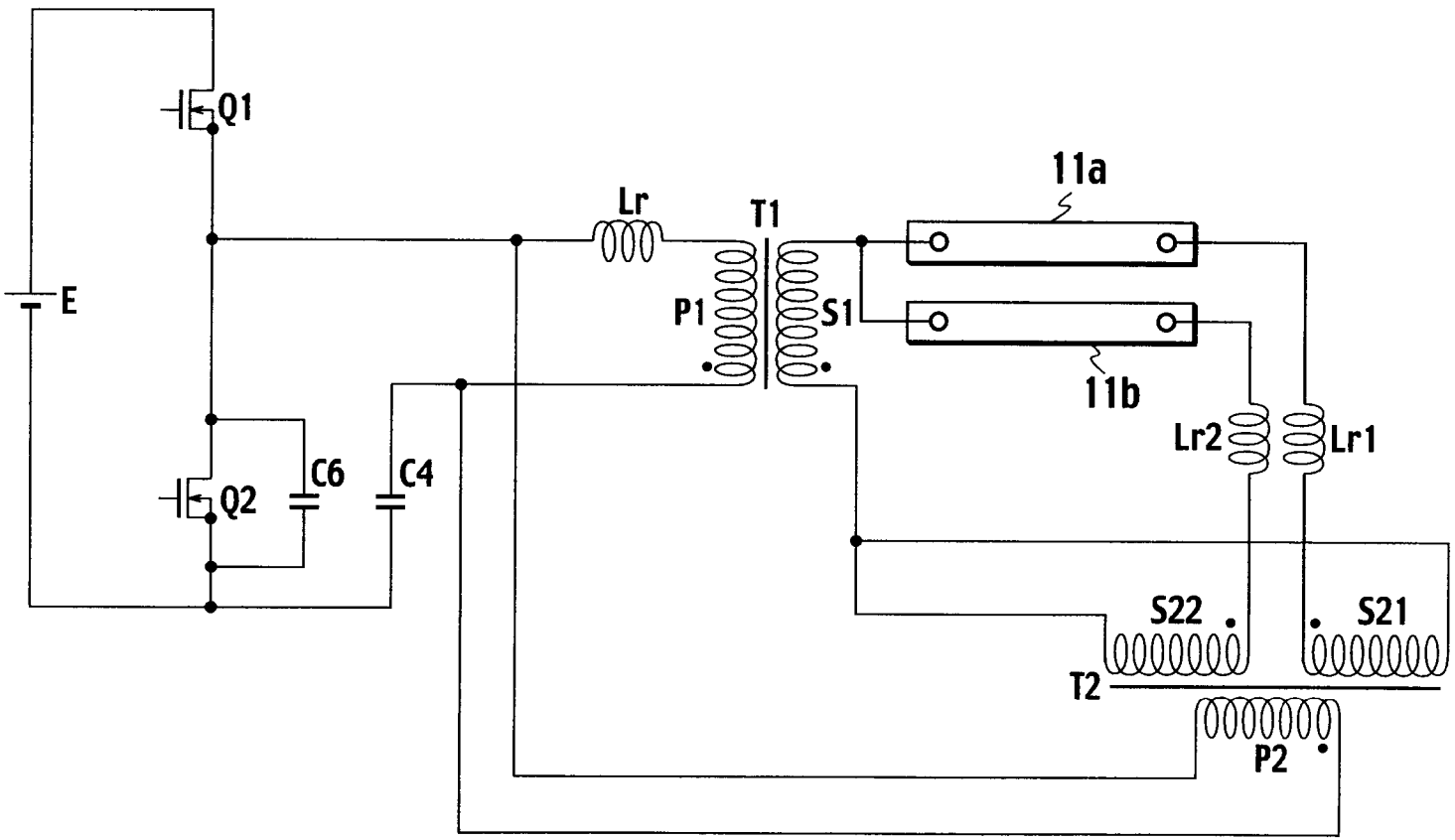
FIG. 3 is a view showing a configuration of a discharge-lamp lighting apparatus according to first embodiment of the present invention.

FIG. 3 is a view showing a discharge-lamp lighting apparatus according to first embodiment of the present invention. The operation and configuration of the primary side of first embodiment are the same as those of the related art shown in FIG. 1, and therefore, explanations thereof are omitted. In FIG. 3, the control circuit 10 and current detection resistor RS are not shown.

Parts of first embodiment that are different from those of the related art will mainly be explained. Through the drawings, a filled circle indicates a winding start point of each transformer winding. Although discharge lamps in the embodiments are CCFLs, they may be external electrode fluorescent lamps, fluorescent lamps, and the like.

On the secondary side of the apparatus, there is a second transformer T2 instead of the first and second ballast capacitors C11 and C12 of the related art. The second transformer T2 has a primary winding P2, a first secondary winding S21, and a second secondary winding S22. The three windings of the second transformer T2 are wound in order of S21, P2, and S22. The primary winding P2 and first secondary winding S21 of the second transformer T2 are loosely coupled to each other, the primary winding P2 and second secondary winding S22 of the second transformer T2 are loosely coupled to each other, and the first and second secondary windings S21 and S22 of the second transformer T2 are loosely coupled to each other.

A secondary winding S1 of a first transformer T1 is connected in parallel to a series circuit that includes a CCFL 11*a* and the first secondary winding S21 of the second transformer T2 and a series circuit that includes a CCFL 11*b* and the second secondary winding S22 of the second transformer T2. The primary winding P2 of the second transformer T2 is connected in parallel to a primary winding P1 of the first transformer T1. Polarities of the first and second secondary windings S21 and S22 of the second transformer T2 are set so that voltages generated by the first and second secondary windings S21 and S22 are additive to a voltage generated by the secondary winding S1 of the first transformer T1.

Operation of the discharge-lamp lighting apparatus according to first embodiment with the above-mentioned configuration will be explained. An AC voltage applied to the primary winding P1 of the first transformer T1 and the primary winding P2 of the second transformer T2 makes the secondary winding S1 of the first transformer T1 and the first and second secondary windings S21 and S22 of the second transformer T2 generate voltages. As a result, the CCFL 11*a* receives the sum of the voltage of the secondary winding S1 of the first transformer T1 and the voltage of the first secondary winding S21 of the second transformer T2, and the CCFL 11*b* receives the sum of the voltage of the secondary winding S1 of the first transformer T1 and the voltage of the second secondary winding S22 of the second transformer T2.

As a result, the CCFLs 11*a* and 11*b* turn on. Since the first and second secondary windings S21 and S22 of the second transformer T2 are loosely coupled to each other, ON operation of one of the CCFLs 11*a* and 11*b* do not drop a voltage applied to the other CCFL. Namely, the CCFLs 11*a* and 11*b* can stably be turned on without an influence of voltage drop caused by ON operation of the CCFLs 11*a* and 11*b*.

The loose coupling of the primary winding P2 and first secondary winding S21 of the second transformer T2 forms a leakage inductance Lr1, and the loose coupling of the primary winding P2 and second secondary winding S22 of the second transformer T2 forms a leakage inductance Lr2. These leakage inductances result in balancing currents passed to the CCFLs 11*a* and 11*b*. The voltages applied to the CCFLs 11*a* and 11*b* are shared between the first and second transformers T1 and T2, and therefore, an output voltage provided by any one of the first and second transformers T1 and T2 can be lower than that of the related art. This results in eliminating the need of large-scale safety measures to secure reliability, prevent leakage, and ensure creepage distances and spatial distances, thereby minimizing the cost of the apparatus.

Second Embodiment

Figure 4:
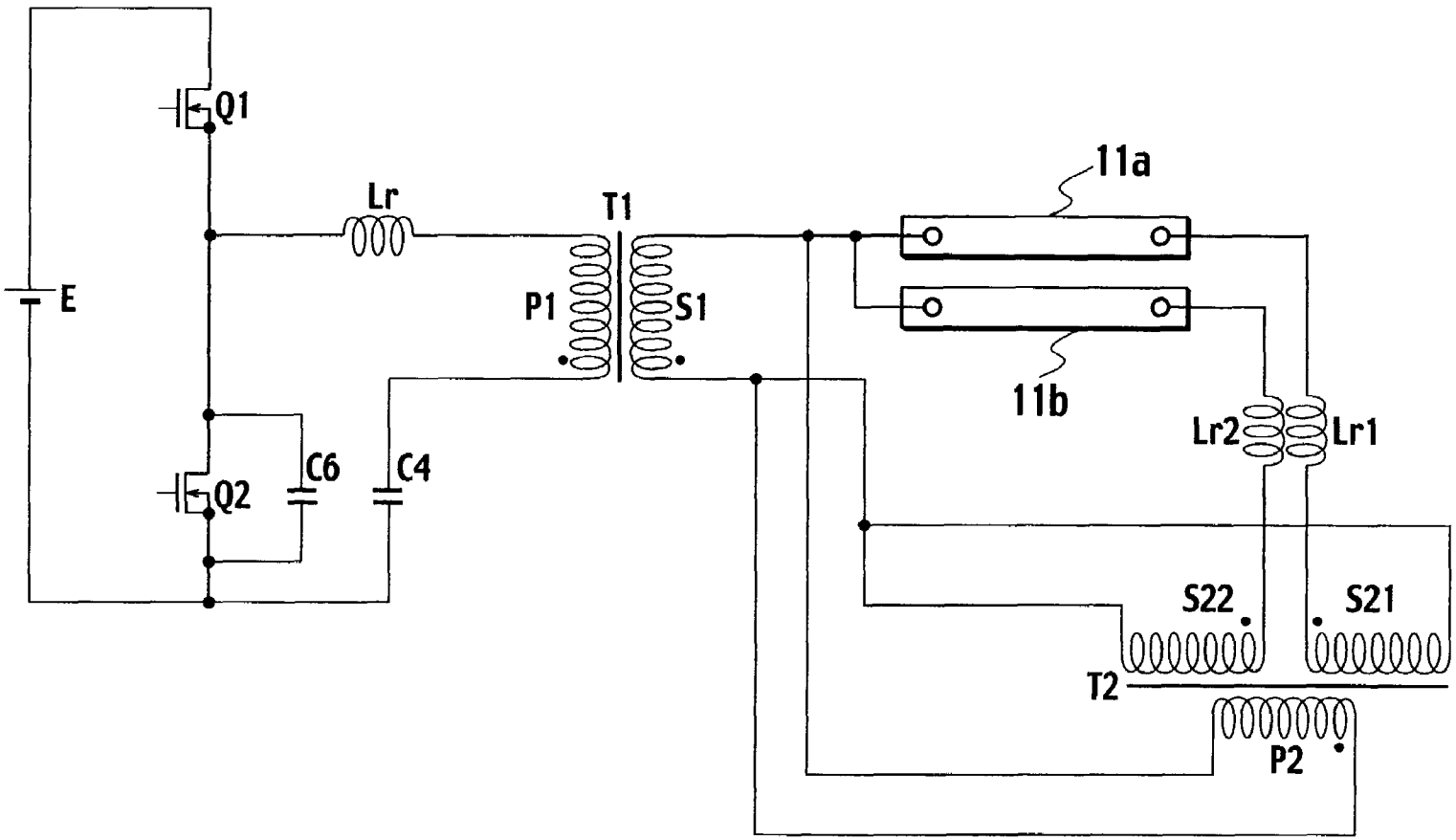
FIG. 4 is a view showing a configuration of a discharge-lamp lighting apparatus according to second embodiment of the present invention.

FIG. 4 is a view showing a configuration of a discharge-lamp lighting apparatus according to second embodiment of the present invention. The primary winding P2 of the second transformer T2 of the discharge-lamp lighting apparatus according to the first embodiment is connected in parallel to the secondary winding S1 of the first transformer T1. The discharge-lamp lighting apparatus according to the present embodiment provides the same operation and effect as the discharge-lamp lighting apparatus according to the first embodiment.

Third Embodiment

Figure 5:
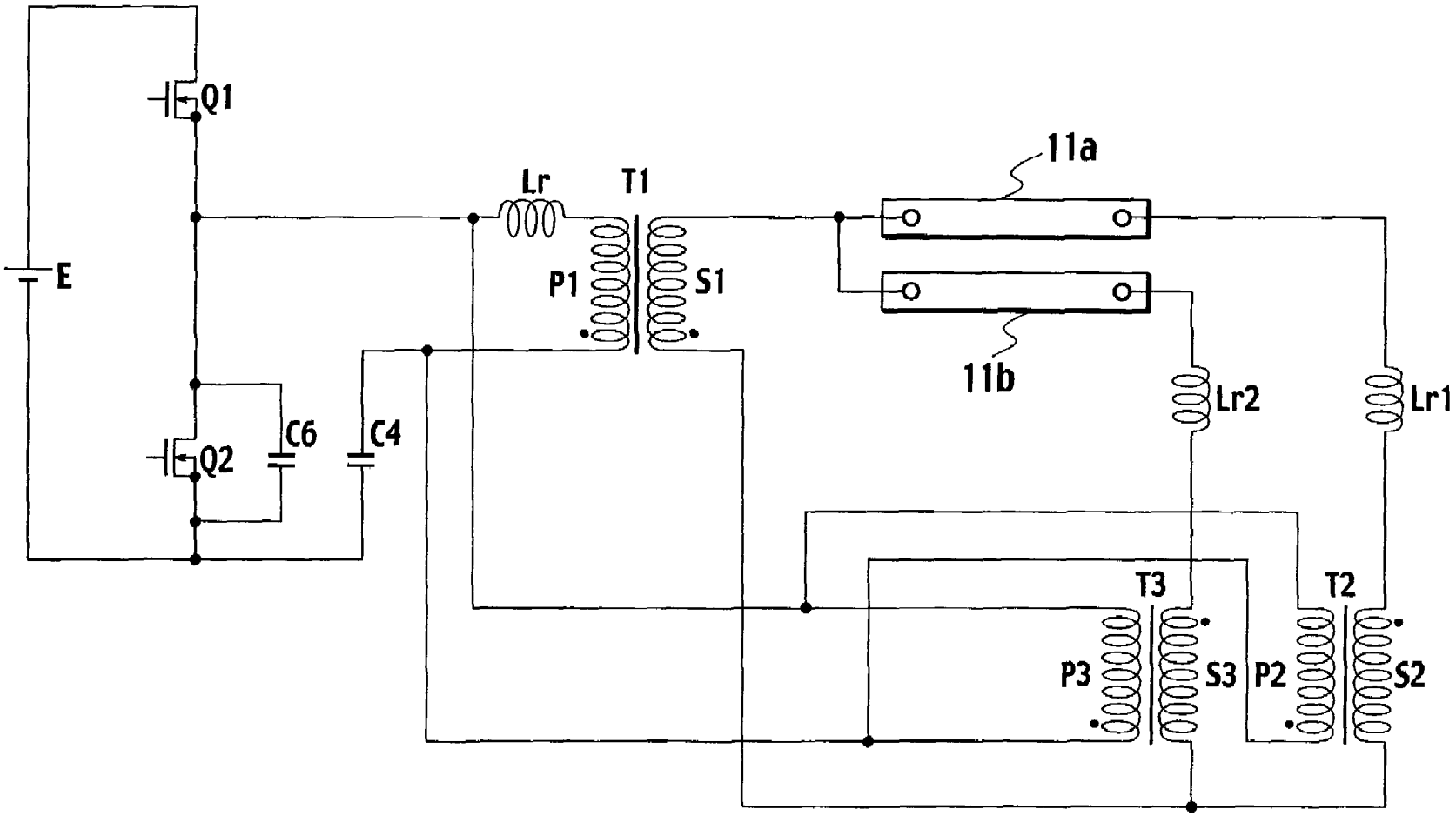
FIG. 5 is a view showing a configuration of a discharge-lamp lighting apparatus according to third embodiment of the present invention.

FIG. 5 is a view showing a configuration of a discharge-lamp lighting apparatus according to third embodiment of the present invention. The second transformer T2 of the discharge-lamplighting apparatus according to the first embodiment is divided into a second transformer T2 and a third transformer T3. The second transformer T2 has a primary winding P2 and a secondary winding S2, and the third transformer T3 has a primary winding P3 and a secondary winding S3.

According to the third embodiment shown in FIG. 5, a secondary winding S1 of a first transformer T1 is connected in parallel to a series circuit that includes a CCFL 11*a* and the secondary winding S2 of the second transformer T2 and a series circuit that includes a CCFL 11*b* and the secondary winding S3 of the third transformer T2. Each of the primary windings P2 and P3 of the second and third transformers T2 and T3 is connected in parallel to the primary winding P1 of the first transformer T1. The secondary windings S2 and S3 of the second and third transformers T2 and T3 are connected to the secondary winding S1 of the first transformer T1 with their polarities being set so that voltages generated by the secondary windings S2 and S3 become additive to a voltage generated by the secondary winding S1 of the first transformer T1.

The primary and secondary windings P2 and S2 of the second transformer T2 are loosely coupled to each other, and the primary and secondary windings P3 and S3 of the third transformer T3 are also loosely coupled to each other.

Operation of the discharge-lamp lighting apparatus according to the third embodiment with the above-mentioned configuration will be explained. An AC voltage applied to the primary windings P1, P2, and P3 of the first, second, and third transformers T1, T2, and T3 makes the secondary windings S1, S2, and S3 of the first, second, and third transformers T1, T2, and T3 generate voltages. As a result, the CCFL 11*a* receives the sum of the voltage of the secondary winding S1 of the first transformer T1 and the voltage of the secondary winding S2 of the second transformer T2.

Similarly, the CCFL 11*b* receives the sum of the voltage of the secondary winding S1 of the first transformer T1 and the voltage of the secondary winding S3 of the third transformer T3.

As a result, the CCFLs 11*a* and 11*b* turn on. Since the secondary windings S2 and S3 of the second and third transformers T2 and T3 are independent of each other, ON operation of one of the CCFLs 11*a* and 11*b* do not drop a voltage applied to the other CCFL. Namely, the CCFLs 11*a* and 11*b* can stably be turned on without an influence of voltage drop caused by ON operation of the CCFLs 11*a* and 11*b*.

The loose coupling of the primary and secondary windings P2 and S2 of the second transformer T2 forms a leakage inductance Lr1, and the loose coupling of the primary and secondary windings P3 and S3 of the third transformer T3 forms a leakage inductance Lr2. These leakage inductances result in balancing currents passed to the CCFLs 11*a* and 11*b*. The voltages applied to the CCFLs 11*a* and 11*b* are shared between the first and second transformers T1 and T2 and between the first and third transformers T1 and T3, and therefore, an output voltage provided by any one of the first to third transformers T1 to T3 can be lower than that of the related art. This results in eliminating the need of large-scale safety measures to secure reliability, prevent leakage, and ensure creepage distances and spatial distances, thereby minimizing the cost of the apparatus.

Fourth Embodiment

Figure 6:
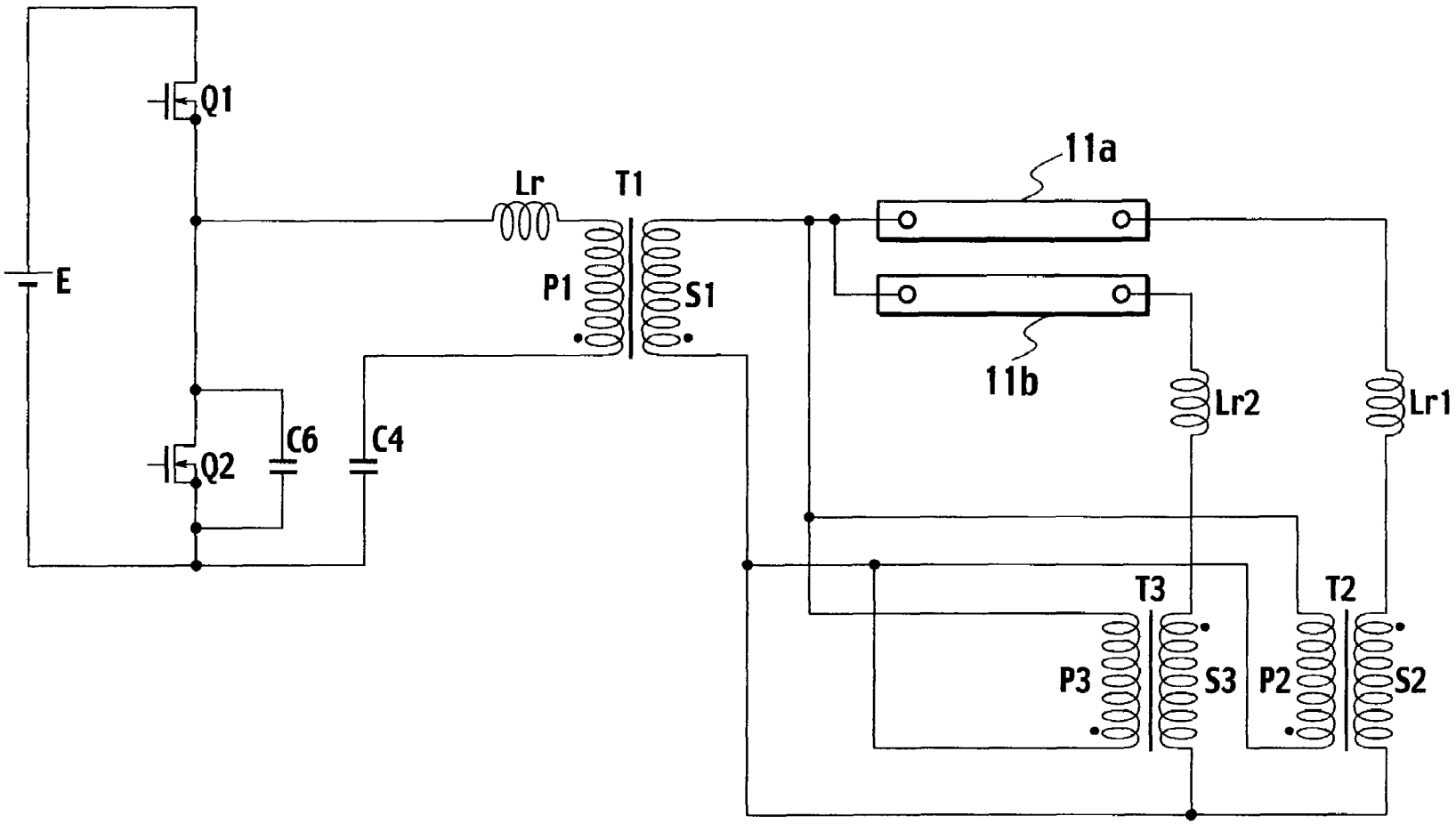
FIG. 6 is a view showing a configuration of a discharge-lamp lighting apparatus according to fourth embodiment of the present invention.

FIG. 6 is a view showing a configuration of a discharge-lamp lighting apparatus according to fourth embodiment of the present invention. Each of the primary windings P2 and P3 of the second and third transformers T2 and T3 of the discharge-lamp lighting apparatus of the third embodiment is connected in parallel to the secondary winding S1 of the first transformer T1. The fourth embodiment provides the same operation and effect as the third embodiment.

Fifth Embodiment

Figure 7:
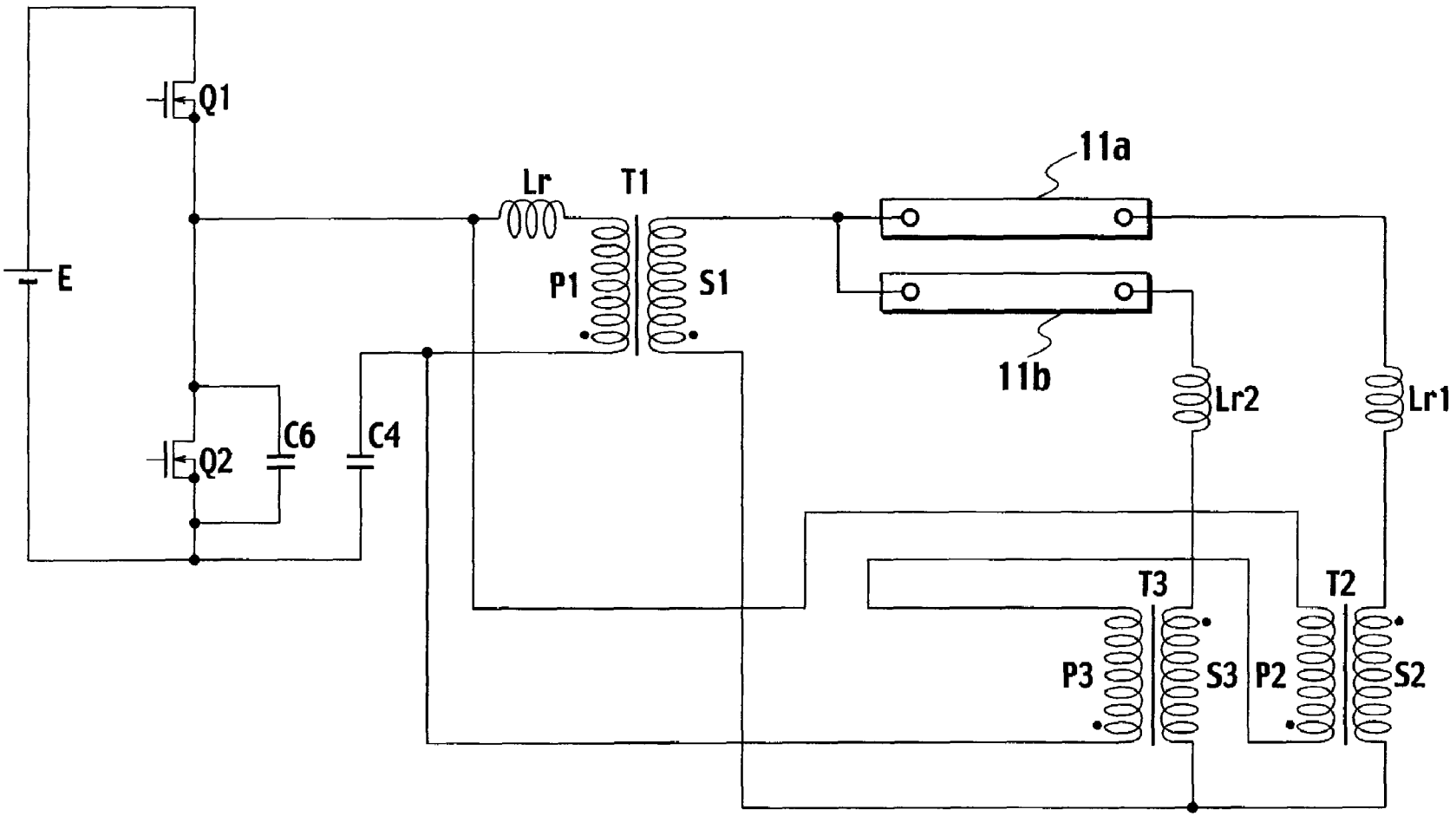
FIG. 7 is a view showing a configuration of a discharge-lamp lighting apparatus according to fifth embodiment of the present invention.

FIG. 7 is a view showing a configuration of a discharge-lamp lighting apparatus according to fifth embodiment of the present invention. The primary windings P2 and P3 of the second and third transformers T2 and T3 of the discharge-lamp lighting apparatus of the third embodiment is connected in series with each other to form a series circuit and this series circuit is connected in parallel to the primary winding P1 of the first transformer T1 of the third embodiment. The fifth embodiment provides the same operation and effect as the third embodiment.

Like the fourth embodiment, the fifth embodiment may be modified to connect the above-mentioned series circuit in parallel to the secondary winding S1 of the first transformer T1. The modification provides the same operation and effect as the fifth embodiment.

Sixth Embodiment

Figure 8:
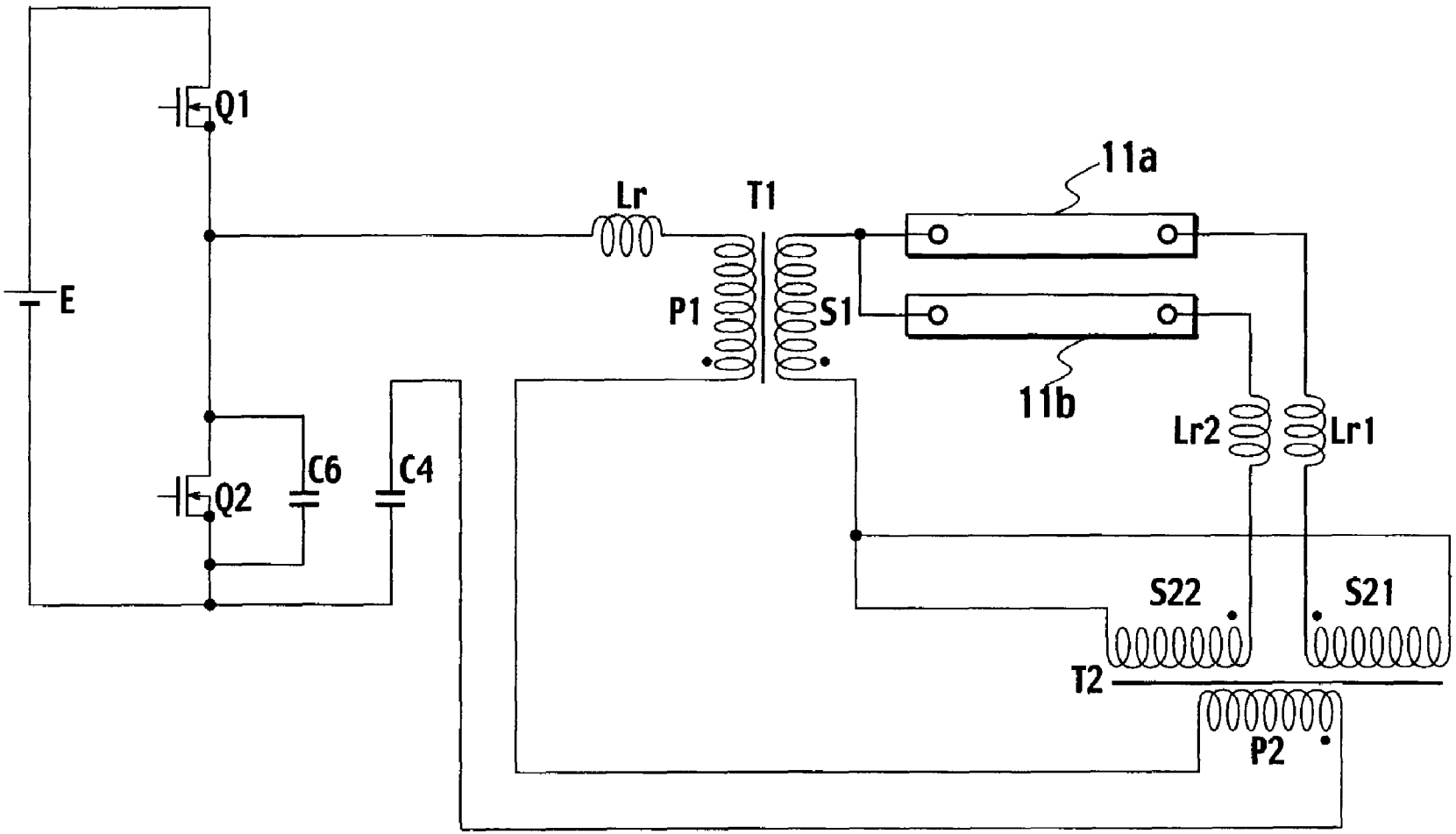
FIG. 8 is a view showing a configuration of a discharge-lamp lighting apparatus according to sixth embodiment of the present invention.

FIG. 8 is a view showing a configuration of a discharge-lamp lighting apparatus according to sixth embodiment of the present invention.

The primary winding P2 of the second transformer T2 of the discharge-lamp lighting apparatus of first embodiment is connected in series with the primary winding P1 of the first transformer T1. The sixth embodiment provides the same operation and effect as the first embodiment.

Like the second embodiment, the sixth embodiment may be modified to connect the primary winding P2 of the second transformer T2 in series with the secondary winding S1 of the first transformer T1. This modification provides the same operation and effect as the second embodiment.

Seventh Embodiment

Figure 9:
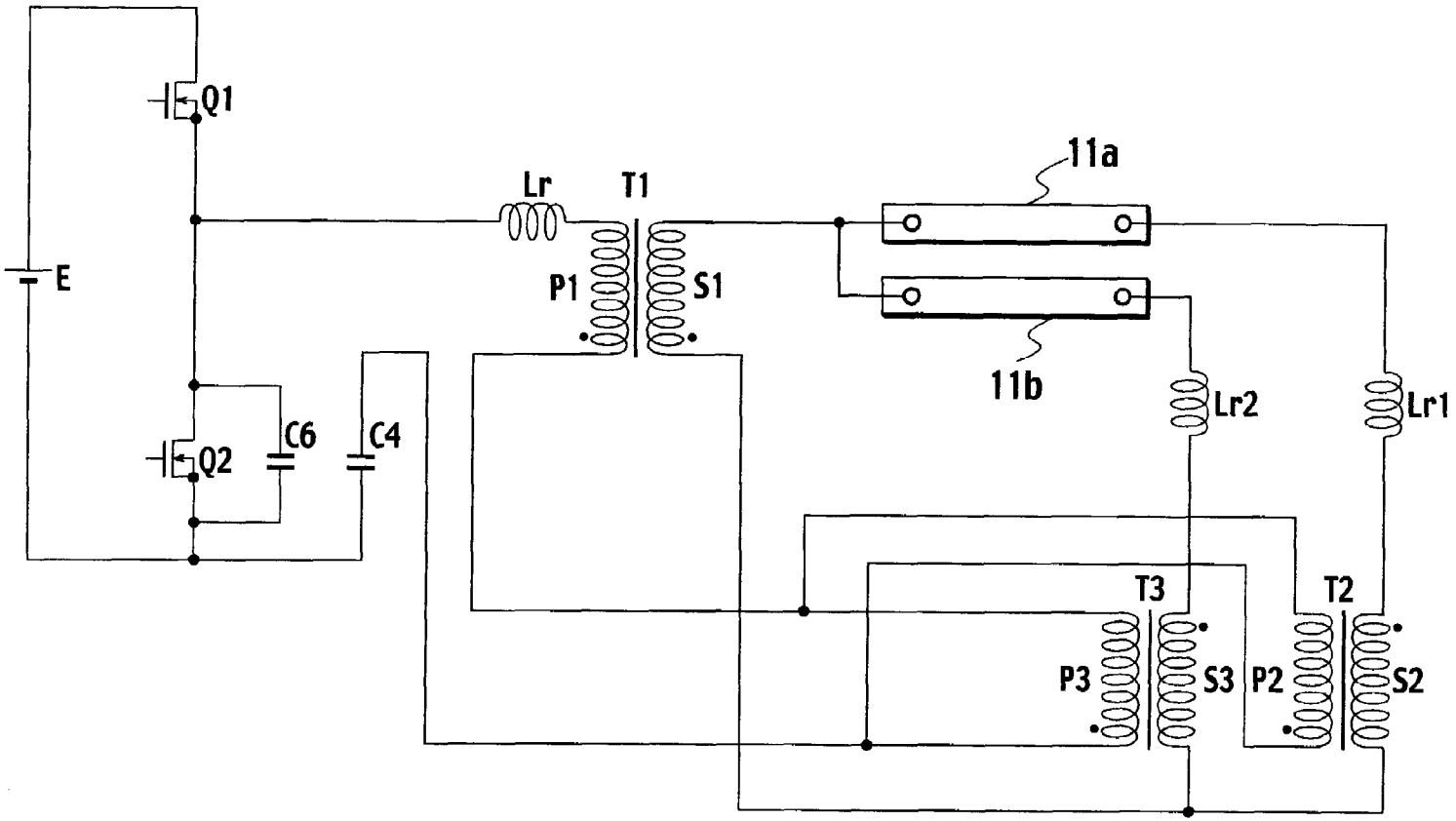
FIG. 9 is a view showing a configuration of a discharge-lamp lighting apparatus according to seventh embodiment of the present invention.

FIG. 9 is a view showing a configuration of a discharge-lamp lighting apparatus according to seventh embodiment of the present invention. Each of the primary windings P2 and P3 of the second and third transformers T2 and T3 of the discharge-lamp lighting apparatus of the third embodiment is connected in series with the primary winding P1 of the first transformer T1. The seventh embodiment provides the same operation and effect as the third embodiment.

Like the fourth embodiment, the seventh embodiment may be modified to connect each of the primary windings P2 and P3 of the second and third transformers T2 and T3 in series with the secondary winding S1 of the first transformer T1. This modification provides the same operation and effect as the fourth embodiment.

Eighth Embodiment

Figure 10:
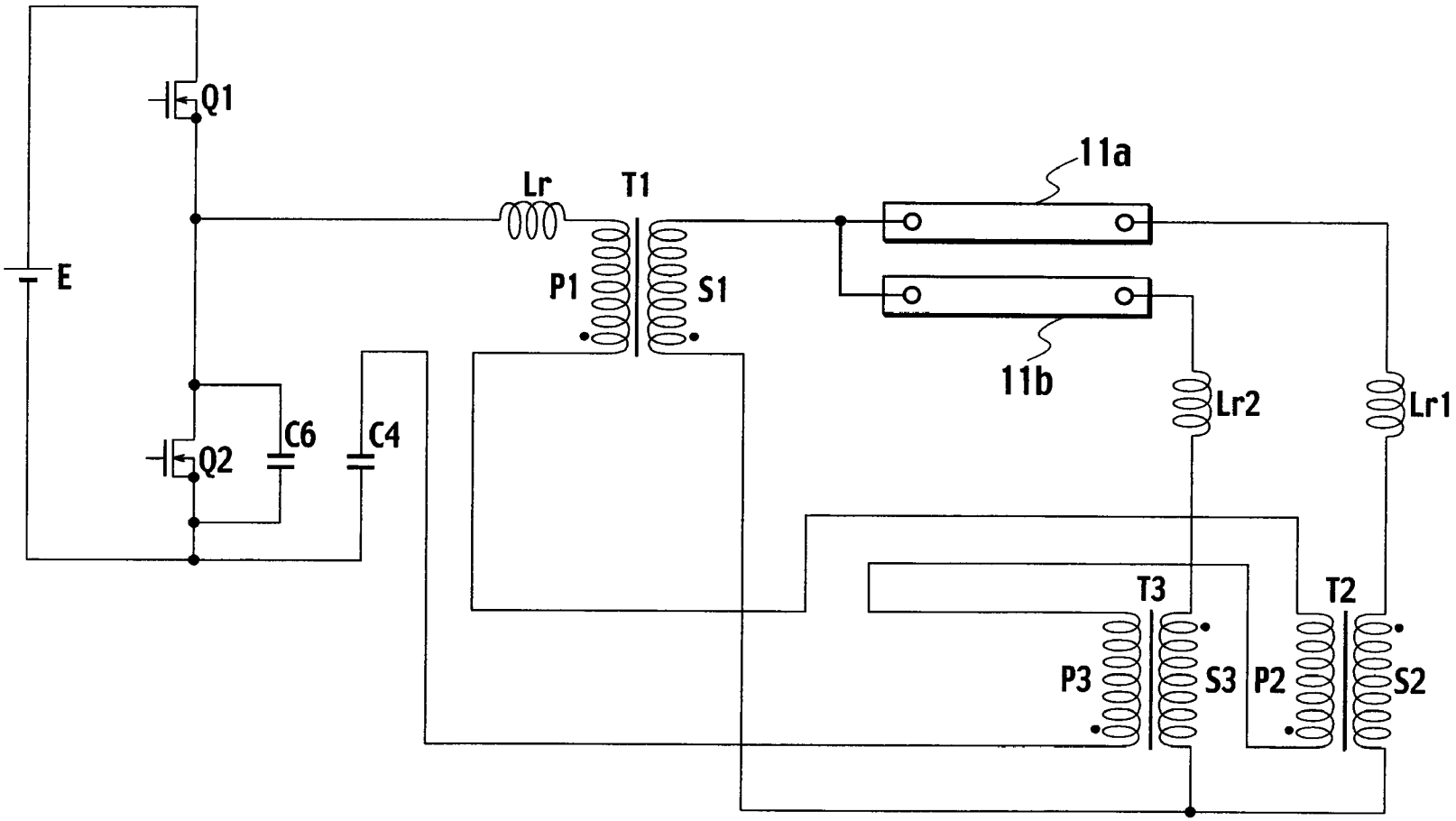
FIG. 10 is a view showing a configuration of a discharge-lamp lighting apparatus according to eighth embodiment of the present invention.

FIG. 10 is a view showing a discharge-lamp lighting apparatus according eighth embodiment of the present invention.

The primary windings P2 and P3 of the second and third transformers T2 and T3 of the discharge-lamp lighting apparatus of third embodiment is connected in series with each other to form a series circuit and this series circuit is connected in series with the primary winding P1 of the first transformer T1. The eighth embodiment provides the same operation and effect as the third embodiment.

Like the fourth embodiment, the eighth embodiment may be modified to connect the series circuit consisting of the primary windings P2 and P3 of the second and third transformers T2 and T3 in series with the secondary winding S1 of the first transformer T1. This modification provides the same operation and effect as the eighth embodiment.

Although each of the first embodiment to the eighth embodiment controls two CCFLs, the present invention is applicable to form a discharge-lamp lighting apparatus that controls an optional number of CCFLs.

The present invention can realize a discharge-lamp lighting apparatus that is manufacturable at low cost, is highly reliable, and is capable of simultaneously driving a plurality of CCFLs.

The discharge-lamp lighting apparatus according to the present invention generates voltages applied to first and second discharge lamps from first and second (and third, too) transformers in a shared manner to reduce a voltage to be generated by each transformer. This results in eliminating large-scale safety measures to be taken for the apparatus, greatly reducing the cost of the apparatus, and improving the reliability of the apparatus.

Supplying voltages to the first and second discharge lamps with the use of the second and/or third transformers provides an advantage that a leakage inductance of each transformer can be used as an impedance to absorb the negative resistance characteristics of the first and second discharge lamps. This results in stabilizing and balancing currents passed to the discharge lamps that are simultaneously driven.

This application claims benefit of priority under 35 USC §119 to Japanese Patent Application No. 2006-145730, filed on May 25, 2006, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A discharge-lamp lighting apparatus having a first discharge lamp and a second discharge lamp, comprising:

a first transformer having a primary winding and a secondary winding, the primary winding receiving an AC voltage generated by turning on/off switching elements that are connected to a DC power source, and the secondary winding transforming the AC voltage received by the primary winding into an output voltage; and a second transformer having a primary winding, a first secondary winding, and a second secondary winding, the primary winding of the second transformer being driven in synchronization with the first transformer, and each of the first and second secondary windings of the second transformer being connected to the secondary winding of the first transformer with polarities being set so that a voltage of each secondary winding of the second transformer becomes additive to a voltage of the secondary winding of the first transformer, wherein the first discharge lamp is connected in parallel to a series circuit that includes the secondary winding of the first transformer and the first secondary winding of the second transformer; and the second discharge lamp is connected in parallel to a series circuit that includes the secondary winding of the first transformer and the second secondary winding of the second transformer.

2. A discharge-lamp lighting apparatus of claim 1, wherein the primary winding of the second transformer is connected in parallel to the primary winding of the first transformer.

3. A discharge-lamp lighting apparatus of claim 1, wherein the primary winding of the second transformer is connected in parallel to the secondary winding of the first transformer.

4. A discharge-lamp lighting apparatus according to claim 1, wherein the primary winding of the second transformer is connected in series with the primary windings of the first transformer.

5. A discharge-lamp lighting apparatus of claim 1, wherein the primary winding and the first secondary winding of the second transformer are loosely coupled to each other;

the primary winding and the second secondary winding of the second transformer are loosely coupled to each other;

the first secondary winding and the second secondary winding of the second transformer are loosely coupled to each other.

* * * * *